US008844100B2

(12) United States Patent
Humphries et al.

(10) Patent No.: US 8,844,100 B2
(45) Date of Patent: Sep. 30, 2014

(54) JEWELRY CLASP AND METHODS THEREOF

(76) Inventors: John Edward Faget Humphries, New Orleans, LA (US); Benjamin John Hamawy, New Orleans, LA (US)

( * ) Notice: Subject to any disclaimer, the term of this patent is extended or adjusted under 35 U.S.C. 154(b) by 111 days.

(21) Appl. No.: 12/826,794

(22) Filed: Jun. 30, 2010

(65) Prior Publication Data

US 2012/0000038 A1 Jan. 5, 2012

Related U.S. Application Data

(63) Continuation of application No. 29/363,321, filed on Jun. 8, 2010, now Pat. No. Des. 630,543, and a continuation of application No. 29/363,322, filed on Jun. 8, 2010, now Pat. No. Des. 642,954, and a continuation of application No. 29/363,317, filed on Jun. 8, 2010, now Pat. No. Des. 629,712, and a continuation of application No. 29/357,976, filed on Mar. 19, 2010, now Pat. No. Des. 635,885.

(51) Int. Cl.
*A44C 5/18* (2006.01)
*A44C 5/20* (2006.01)

(52) U.S. Cl.
CPC ..... *A44C 5/2085* (2013.01); *A44D 2203/00* (2013.01)
USPC ..... 24/303; 63/3.1

(58) Field of Classification Search
CPC ..... A44C 5/2085; A44D 2203/00
USPC ..... 24/303, 587.11, 616; 63/3.1, 900
See application file for complete search history.

(56) References Cited

U.S. PATENT DOCUMENTS

| | | | | |
|---|---|---|---|---|
| 2,615,227 | A | 10/1952 | Hornik | |
| 2,648,884 | A | 8/1953 | Loofboro | |
| 2,956,324 | A | 10/1960 | Klein | |
| 3,041,697 | A * | 7/1962 | Budreck | 24/303 |
| 3,621,690 | A | 11/1971 | Whitcomb | |
| 4,231,137 | A * | 11/1980 | Fujimoto | 24/303 |
| 5,008,984 | A * | 4/1991 | Levy | 24/303 |
| 5,092,019 | A * | 3/1992 | Levy | 24/303 |
| D325,546 | S | 4/1992 | Collier | |
| 5,197,168 | A * | 3/1993 | Levy | 24/303 |
| 5,317,789 | A * | 6/1994 | Levy | 24/303 |
| 5,664,298 | A | 9/1997 | Nessar-Ivanovic | |
| 6,595,025 | B2 * | 7/2003 | Lau | 63/3.1 |
| 6,598,271 | B2 | 7/2003 | Nire | |
| 6,640,398 | B2 | 11/2003 | Hoffman | |
| 6,848,288 | B1 * | 2/2005 | Derman | 70/459 |
| 7,152,282 | B2 | 12/2006 | Costa | |
| 7,207,091 | B2 * | 4/2007 | Dunaye | 24/303 |
| 7,334,433 | B1 | 2/2008 | Fuhrman et al. | |
| 7,523,527 | B2 * | 4/2009 | Garber | 24/303 |
| 7,564,331 | B2 * | 7/2009 | Hashimoto | 335/207 |
| 7,690,088 | B2 * | 4/2010 | Kogen | 24/303 |

* cited by examiner

*Primary Examiner* — Robert J Sandy
*Assistant Examiner* — Louis Mercado
(74) *Attorney, Agent, or Firm* — Amster, Rothstein & Ebenstein LLP

(57) ABSTRACT

A jewelry clasp including at least a first jewelry interfacer and a second jewelry interfacer capable of magnetically coupling together. The magnetic coupling of the first and second jewelry interfacers can be substantially easy to decouple by applying force substantially in a first direction, but substantially difficult to decouple by applying force that is not substantially in the first direction. Accordingly, the jewelry clasp can be capable of being decoupled by a user with substantial ease while remaining substantially difficult to decouple when not desired.

19 Claims, 16 Drawing Sheets

JEWELRY CLASP AND METHODS THEREOF

CROSS-REFERENCE TO RELATED APPLICATIONS

This application claims priority to U.S. Design patent application Ser. No. 29/357,976 filed Mar. 19, 2010; U.S. Design patent application Ser. No. 29/363,321 filed Jun. 8, 2010; U.S. Design patent application Ser. No. 29/363,322 filed Jun. 8, 2010; and U.S. Design patent application Ser. No. 29/363,317 filed Jun. 8, 2010, the contents of which are incorporated herein by reference in their entirety.

FIELD OF THE INVENTION

The present invention relates to a magnetically coupled jewelry clasp that can be decoupled with substantial ease by applying force slightly greater than the magnetic coupling force in a first direction, but the coupled jewelry clasp cannot be decoupled with substantial ease by applying force that is not in the first direction.

SUMMARY OF THE INVENTION

In exemplary embodiments, a jewelry clasp can comprise a first jewelry interfacer that can include a first jewelry retainer affixed to a male magnetic interfacer, the male magnetic interfacer can also include a cantilevered male protrusion. The first jewelry retainer can retain jewelry that extends substantially at a non-zero angle to the cantilevered male protrusion. The jewelry clasp can further comprise a second jewelry interfacer that can include a second jewelry retainer affixed to a female magnetic interfacer, the female magnetic interfacer can also include a female receiving region. The second jewelry retainer can retain jewelry that extends substantially at a non-zero angle to the female receiving region. Further, the cantilevered male protrusion can be capable of being received into the female receiving region and the first and second jewelry retainers can magnetically couple to each other such that the cantilevered male protrusion and the female receiving region can remain substantially parallel to each other and the first and second jewelry retainers can retain jewelry that extends substantially at a non-zero angle to the cantilevered male protrusion and/or the female receiving region.

In exemplary embodiments, when force is applied by jewelry retained in the first and/or second jewelry retainers at least some of the retaining force can be absorbed and/or distributed and/or distributed on the cantilevered male protrusion by a moment and/or shear stress.

In exemplary embodiments, the first jewelry interfacer and the second jewelry interfacer can be decoupled by applying a force large enough to overcome the magnetic coupling force in a direction that is substantially parallel to the cantilevered male protrusion.

In exemplary embodiments, a region of the female magnetic interfacer and/or a region of the cantilevered male protrusion can include a magnet and/or ferromagnetic material.

In exemplary embodiments, a region of the female magnetic interfacer can include at least one magnet and/or a region of the cantilevered male protrusion can include at least one magnet. Further, in exemplary embodiments, the at least one magnet of the cantilevered male protrusion can be located substantially near the distal most point of the cantilevered male protrusion and the at least one magnet of the female magnetic interfacer can be located at substantially near the deepest point of the female region.

In exemplary embodiments, the at least one magnet of the cantilevered male protrusion can be located substantially along the length of the cantilevered male protrusion and the at least one magnet of the female magnetic interfacer can be located substantially along the length of the female region. In exemplary embodiments, the cantilevered male protrusion can substantially be and/or can be constructed of one or more magnets.

In exemplary embodiments, the cross-sectional shape of the cantilevered male protrusion and/or the female magnetic interfacer can be substantially round, square, polygonal, triangular, star shaped, quadrilateral, pentagonal, hexagonal, octagonal, enneagonal, and/or decagonal. In exemplary embodiments, the cross-sectional shape of the cantilevered male protrusion and the female magnetic interfacer can be square. In exemplary embodiments, the cross-sectional shape of the elements of the jewelry clasp can include at least one curved surface.

In exemplary embodiments, the first jewelry retainer, the second jewelry retainer, the male magnetic interfacer, the cantilevered male protrusion, and the female magnetic interfacer can each be rectangular cuboid, a square cuboid, and/or a parallelepiped shape. Further, the cantilevered male protrusion and the female magnetic interfacer can each be rectangular cuboid, a square cuboid, and/or a parallelepiped shape.

In exemplary embodiments, when the first jewelry interfacer and the second jewelry interfacer are coupled they can form a shape that is rectangular cuboid, a square cuboid, and/or a parallelepiped shape.

In exemplary embodiments, at least one of the first jewelry retainer and the second jewelry retainer can retain at least one string of beads. Further, the at least one string of beads can be retained in a channel.

In exemplary embodiments, the male magnetic interfacer and the cantilevered male protrusion can be combined into substantially one cantilevered male magnetic interfacer that is affixed to the first jewelry retainer.

In exemplary embodiments, the first jewelry retainer, the second jewelry retainer, the male magnetic interfacer, the cantilevered male protrusion, and/or the female magnetic interfacer can be at least partially constructed of gold, silver, platinum, aluminum, pewter, palladium, any other reasonable material.

In exemplary embodiments, the jewelry clasp can further comprise at least one interim jewelry interfacer that can include an interim female magnetic interfacer affixed to an interim male magnetic interfacer such that the interim female magnetic interfacer and the interim male magnetic interfacer can be affixed in a position substantially parallel to each other. The interim male magnetic interfacer can include an interim cantilevered male protrusion. The interim female magnetic interfacer can be capable receiving the cantilevered male protrusion of the first jewelry interfacer such that the interim female magnetic interfacer and cantilevered male protrusion of the first jewelry interfacer can be magnetically coupled. Further, the interim cantilevered male protrusion can be capable of being inserted into the female magnetic interfacer of the second jewelry interfacer such that the interim male magnetic interfacer and female magnetic interfacer of the second jewelry interfacer can be magnetically coupled.

In exemplary embodiments, an interim jewelry clasp can include an interim jewelry interfacer that can include an interim female magnetic interfacer affixed to an interim male magnetic interfacer such that the interim female magnetic interfacer and the interim male magnetic interfacer can be affixed in a position substantially parallel to each other. The interim male magnetic interfacer can include an interim cantilevered male protrusion. The interim female magnetic interfacer can be capable receiving a cantilevered male protrusion of a first jewelry interfacer such that the interim female magnetic interfacer and cantilevered male protrusion of the first jewelry interfacer can be magnetically coupled. Further, the interim cantilevered male protrusion can be capable of being inserted into a female magnetic interfacer of a second jewelry interfacer such that the interim male magnetic interfacer and female magnetic interfacer of the second jewelry interfacer can be magnetically coupled.

BRIEF DESCRIPTION OF THE DRAWINGS

The features and advantages of the present invention will be more fully understood with reference to the following, detailed description of illustrative embodiments of the present invention when taken in conjunction with the accompanying figures, wherein.

DETAILED DESCRIPTION

Generally, the jewelry clasp of the present invention includes at least a first jewelry interfacer and a second jewelry interfacer capable of magnetically coupling together. The magnetic coupling can be designed such that the first and second jewelry interfacers can decouple with substantial ease by applying force substantially in a first direction. However, the first and second jewelry interfacers may be substantially difficult to decouple when force is applied that is not substantially in the first direction. As described below, the first direction can be defined by elements of the jewelry clasp which couple together. Further, the first and second jewelry interfacers can be coupled to at least one article of jewelry that can be at a substantial angle to the first direction. Thus, force applied from the article of jewelry on the jewelry clasp may not be applied substantially in the first direction making it substantially difficult to decouple the first and second jewelry interfacers.

Figure 1A:
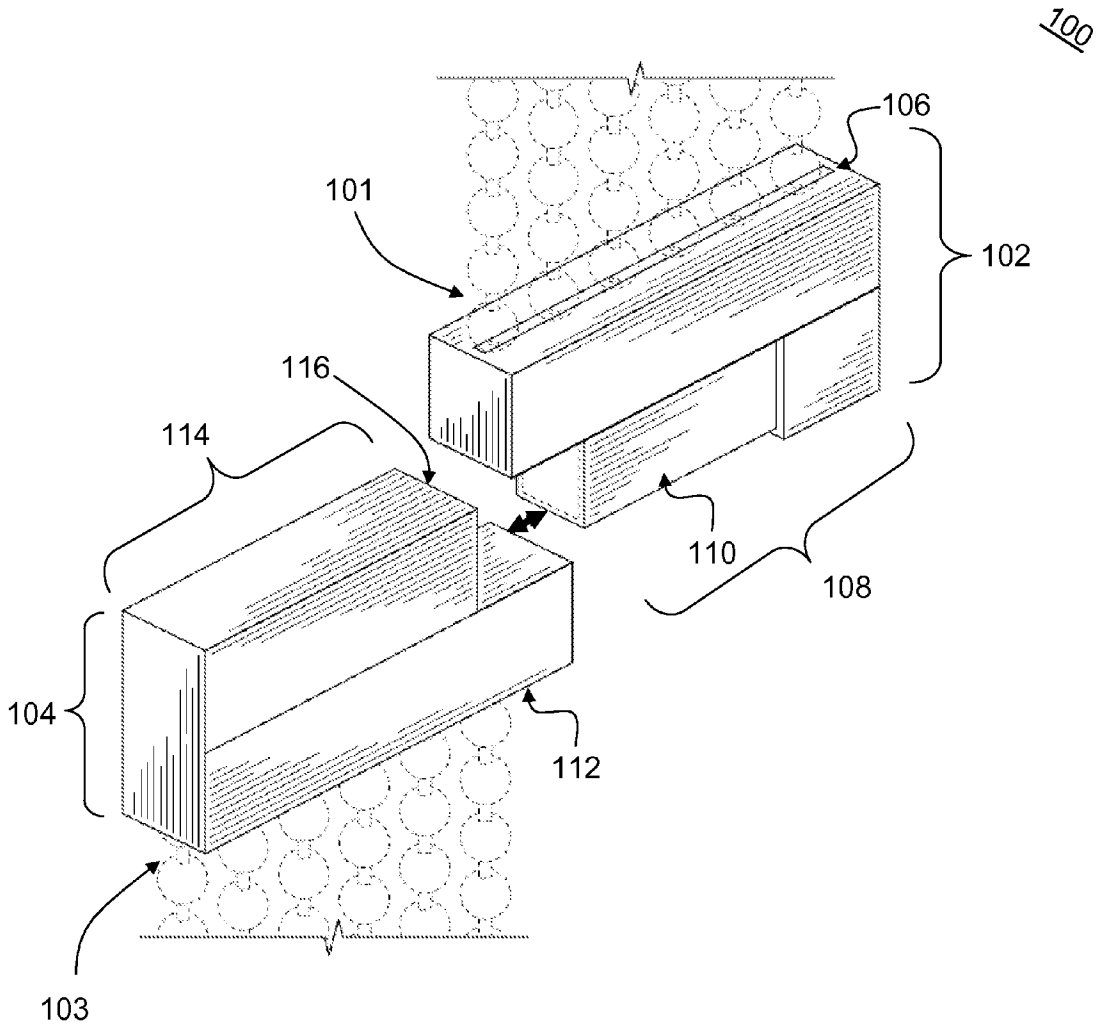
FIGS. 1A-1B illustratively depict a decoupled jewelry clasp of the present invention.
Figure 1B:
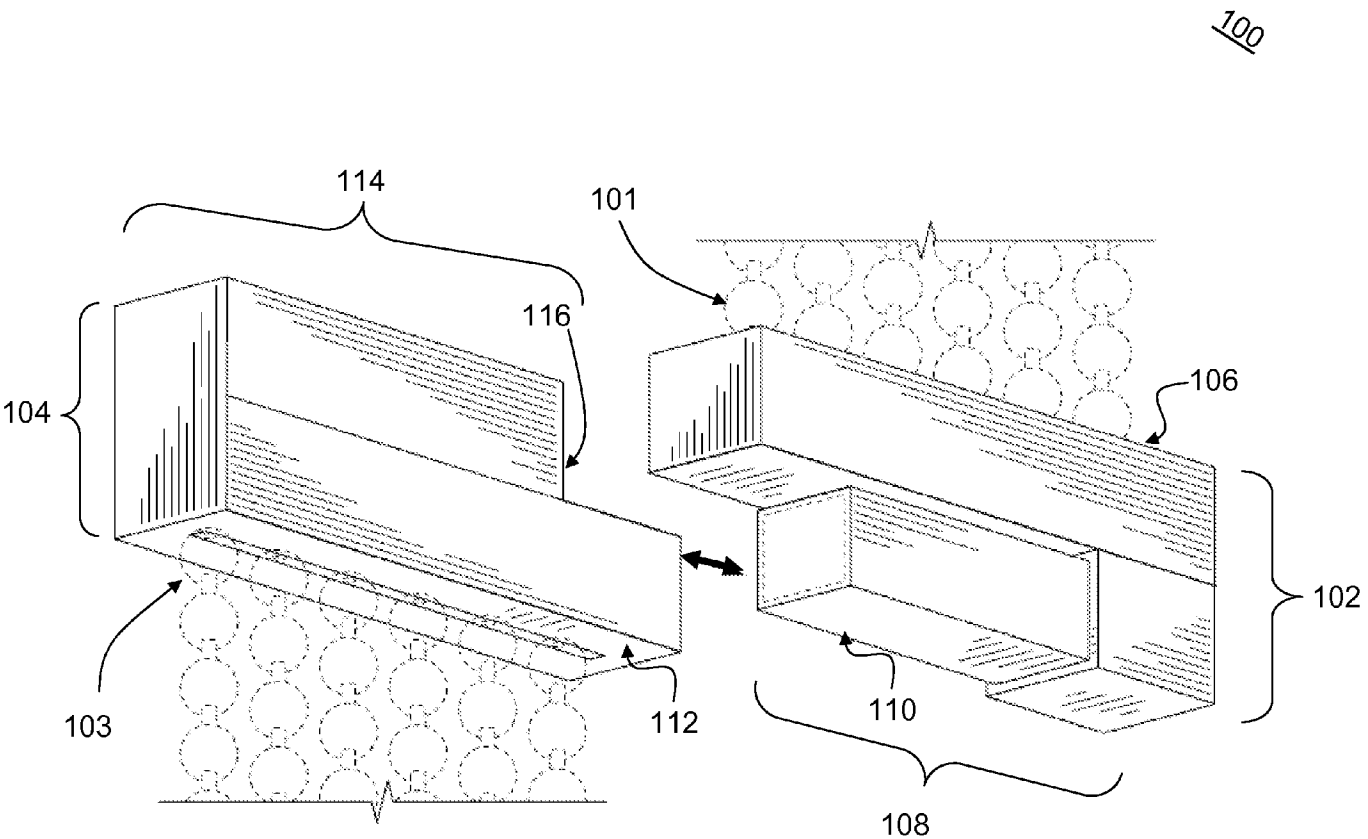

Referring to FIGS. 1A-1B, in exemplary embodiments, a jewelry clasp 100 can include a first jewelry interfacer 102 and a second jewelry interfacer 104. First jewelry interfacer 102 can include a first jewelry retaining region 106 capable of retaining an end 101 of an article of jewelry. Further, first jewelry interfacer 102 can include a male magnetic interfacing region 108 having a cantilevered male protrusion 110. Second jewelry interfacer 104 can include a second jewelry retaining region 112 capable of retaining an end 103 of an article of jewelry. Further, second jewelry interfacer 104 can include a female magnetic interfacing region 114 having a female receiving region 116.

In exemplary embodiments, first and/or second jewelry interfacer 102/104 can include at least one magnetic material (not shown) and female receiving region 116 can receive cantilevered male protrusion 110 such that first and second jewelry interfacer 102/104 magnetically couple when cantilevered male protrusion 110 is received by female receiving region 116. The combination of the at least one magnetic material and the mechanical interactions of female receiving region 116 receiving cantilevered male protrusion 110 can substantially limit the direction in which force can be applied to decouple the first and second jewelry interfacer 102/104 with substantial ease.

Figure 2B:
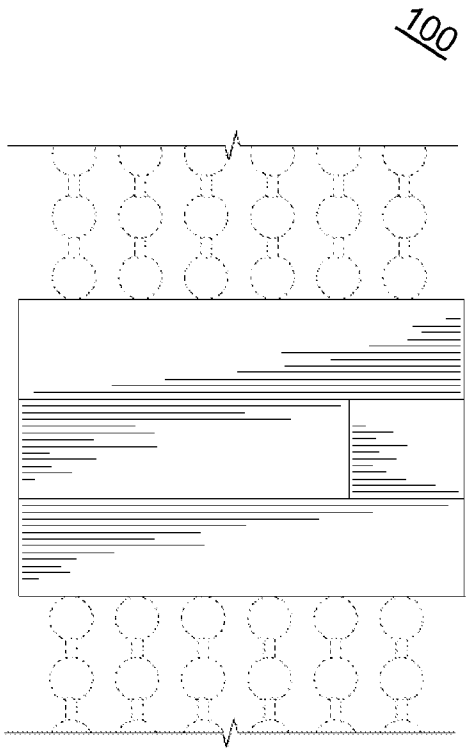
FIGS. 2A-2B illustratively depict a coupled and decoupled jewelry clasp of the present invention.
Figure 2A:
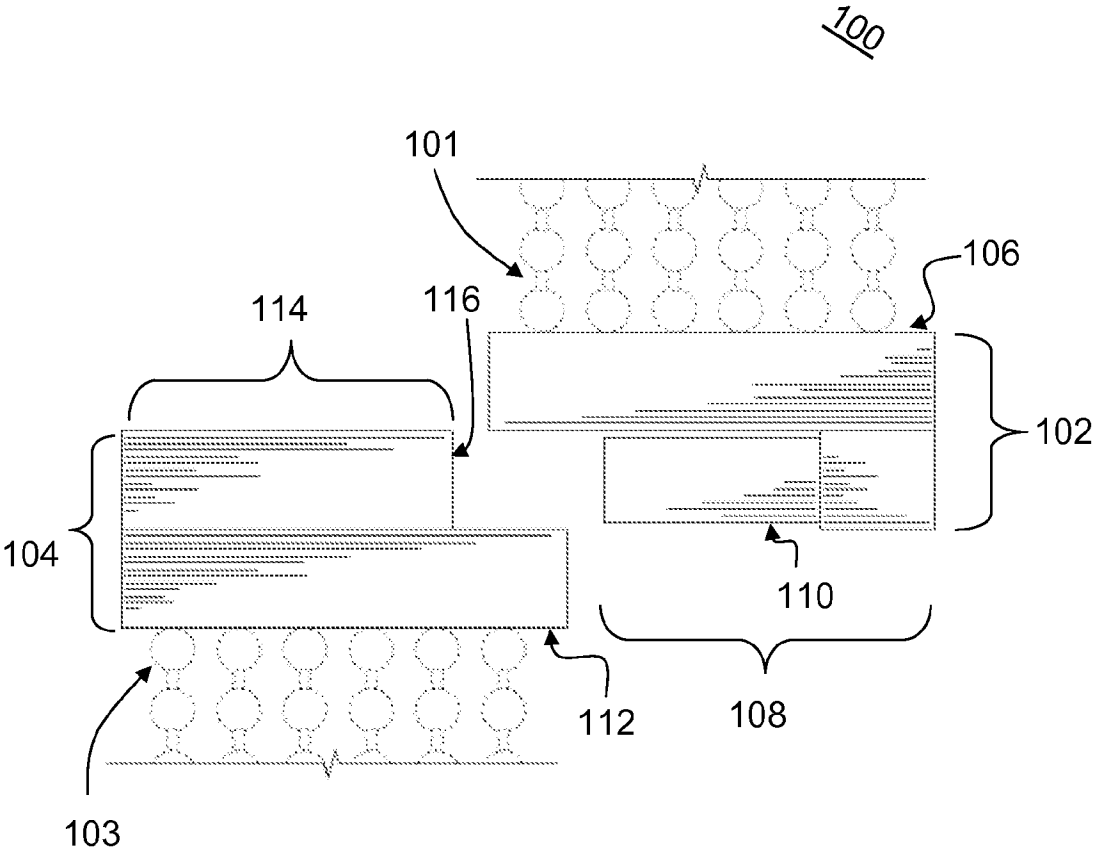

For example, referring to FIGS. 2A-2B, jewelry clasp 100 can be coupled by receiving cantilevered male protrusion 110 into female receiving region 116 such that magnets located in first and/or second jewelry interfacer 102/104 magnetically attract and cause first jewelry interfacer 102 and second jewelry interfacer 104 to magnetically couple. In exemplary embodiments, when first and second jewelry interfacer 102/104 are magnetically coupled together, forces applied from ends 101/103 of an article of jewelry can be substantially absorbed and/or distributed by mechanical interactions of jewelry clasp 100. Since these forces are absorbed and/or distributed, the amount of force applied against the magnetic coupling may not be enough to overcome the magnitude of magnetic attractive force coupling the first and second jewelry interfacer 102/104. Further, forces applied from ends 101/103 of an article of jewelry may not be substantially applied in a direction that can cause the first jewelry interfacer 102 and second jewelry interfacer 104 to magnetically decouple.

Figure 3B:
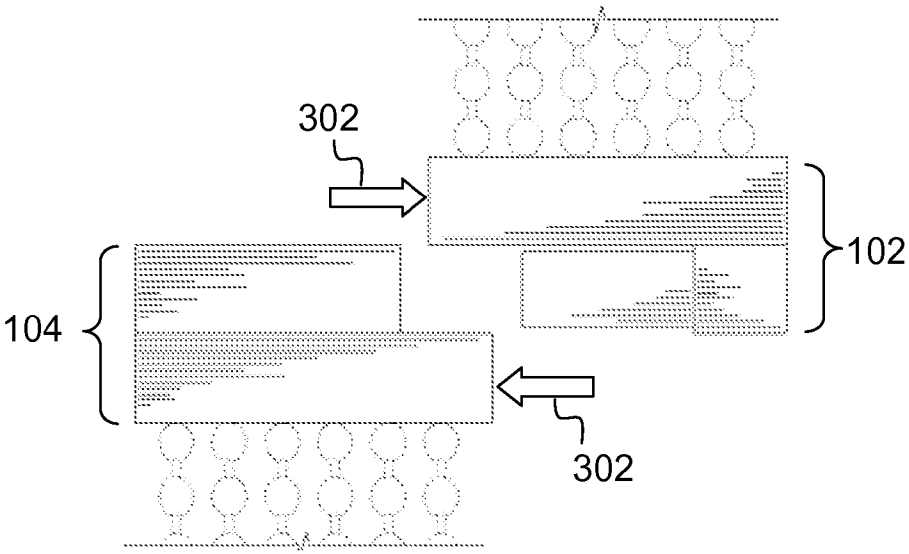
FIGS. 3A-3B illustratively depict the direction of force applied on a jewelry clasp of the present invention.
Figure 3A:
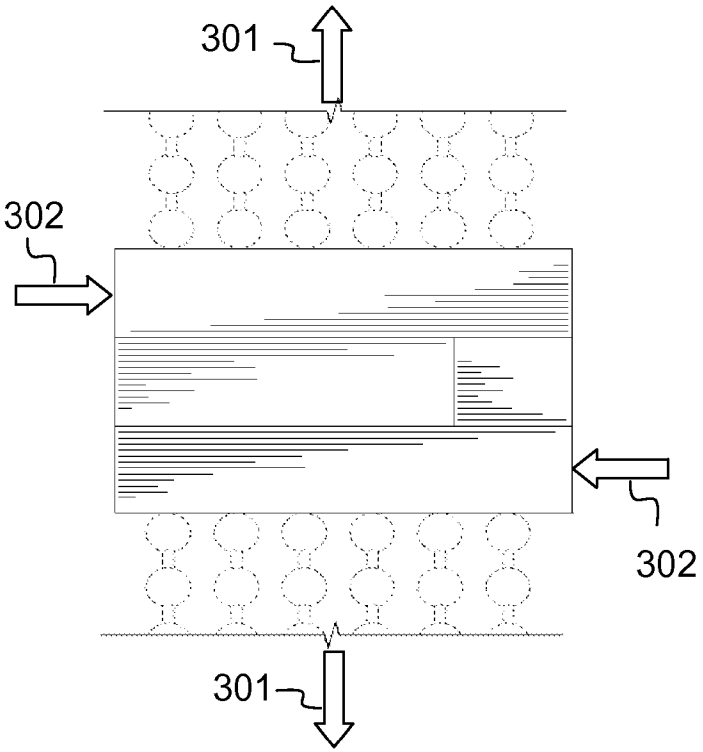

Referring to FIGS. 3A-3B, when first and second jewelry interfacer 102/104 are magnetically coupled together, force 301 applied from ends 101/103 of an article of jewelry can be absorbed and/or distributed by the mechanical properties of at least some of the elements of first and second jewelry interfacer 102/104. Mechanical properties can be, but are not limited to, a moment and/or shear stress created by interactions with cantilevered male protrusion 110 and other elements of first and second jewelry interfacer 102/104, deformation of at least some elements of first and second jewelry interfacer 102/104, and any other mechanical property capable of absorbing and/or distributing force. Noting these mechanical properties, jewelry clasp 100 can be substantially difficult to decouple when force 301 is exerted from end 101/103 of jewelry because the magnitude and/or direction of force 301 may not be applied directly and/or substantially translated in the direction needed to overcome the magnitude of magnetic attractive force coupling first and second jewelry interfacer 102/104.

In exemplary embodiments, when first and second jewelry interfacer 102/104 are magnetically coupled together, force 302 can be applied by, for example, a user to decouple first and second jewelry interfacer 102/104 with substantial ease. Force 302 may only be, but is not limited to, slightly stronger than the magnitude of magnetic attractive force coupling first and second jewelry interfacer 102/104 and force 302 can be applied in a direction substantially parallel to the length of female receiving region 116 and/or cantilevered male protrusion 110. By way of example, if a user applies force 302 that is larger than the magnitude of magnetic attractive force coupling first and second jewelry interfacer 102/104 together and force 302 is applied in a direction substantially parallel to the length of female receiving region 116 and/or cantilevered male protrusion 110, jewelry clasp 100 can be decoupled with substantial ease and cantilevered male protrusion 110 can slide out of female receiving region 116. Thus, an ordinary person can apply a force that is not substantially difficult to decouple jewelry clasp 100, but this force required to decouple jewelry clasp 100 may be large enough such that jewelry clasp 100 does not substantially risk decoupling accidently and/or when not desired by the user.

In exemplary embodiments, the force required to decouple first and second jewelry interfacer 102/104 may increase as the angle of the applied forces direction moves from substantially parallel, at a zero angle, to cantilevered male protrusion 110 through various non-zero angles to substantially perpendicular, at a non-zero ninety degree angle, to cantilevered male protrusion 110.

It will be understood that the article of jewelry can be any article/ornament and/or plurality of articles/ornaments such as, but not limited to, a necklace, earrings, bracelet, watch, anklet, or any other reasonable article/ornament worn as an adornment. In some instances, the article of jewelry can be any plurality of items intended to be releasably coupled. Further, the article of jewelry need not directly connect first jewelry interfacer 102 and second jewelry interfacer 104. For example, any number of additional jewelry interfacers can be located between first jewelry interfacer 102 and second jewelry interfacer 104. For ease, at times, the article of jewelry is described as a beaded necklace connected at both ends to jewelry interfacers. This is in no way meant to be a limitation, rather it is merely for ease.

Figure 4A:
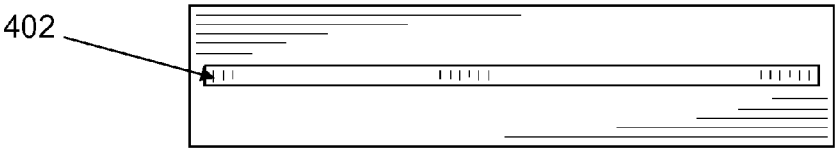
FIGS. 4A-4D illustratively depict various jewelry retaining regions of a jewelry clasp of the present invention.
Figure 4B:
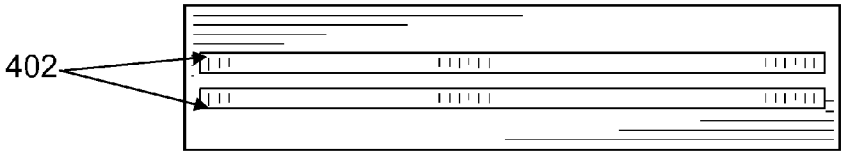
Figure 4C:
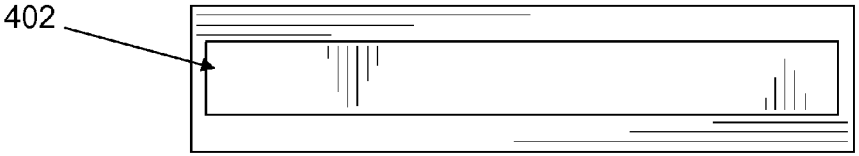
Figure 4D:
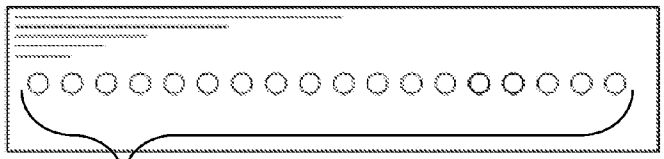

Referring to FIGS. 4A-D, in exemplary embodiments, jewelry retaining region 106/112 can include at least one slot and/or openings 402 for receiving at least one end of an article of jewelry. For example, referring to FIG. 4A, a single slot 402 can retain a single row of beads; referring to FIG. 4B, a plurality of slots 402 can retain a plurality of rows of beads; and, referring to FIG. 4C, the size of slot 402 can be large enough to retain a plurality of rows of beads. Referring to FIG. 4D, slot 402 can include a plurality of openings. These openings can be designed to receive a single column of beads which may combine to form a row of beads. Further, the shape of slot 402 can be any reasonable shape such as round, square, polygonal, triangular, star shaped, quadrilateral, pentagonal, hexagonal, octagonal, enneagonal, and decagonal, to name a few.

In exemplary embodiments, at least one end of an article of jewelry can be affixed to the surface, and/or some surface variation, of jewelry retaining region 106/112. For example, jewelry retaining region 106/112 may not include a slot and/or opening and at least one end of an article of jewelry can be affixed to, for example, the surface of jewelry retaining region 106/112 by any reasonable technique, such as, but not limited to, solder, adhesive, and/or by any technique. The surface of jewelry retaining region 106/112 can be substantially smooth and/or can include surface variations such as, but not limited to, dimples, grooves, and/or any other variation. Further, any combination of any number of slots, openings, surfaces, and surface variations can be combined and/or further separated without deviating from the scope of the invention.

It will be understood that any number of articles of jewelry can be affixed to any number of jewelry interfacers by any technique such as, but not limited to, mechanically affixing, adhesively adhering, chemically bonding, by any combination thereof, or by any other reasonable technique capable of affixing jewelry to an interfacer. Mechanically affixing can include any technique such as, but is not limited to, retaining a region and/or end of an article of jewelry, surrounding a region and/or end of an article of jewelry, deforming a region and/or end of an article of jewelry, soldering a region and/or end of an article of jewelry, welding a region and/or end of an article of jewelry, any combination thereof, or any other mechanical affixing technique capable of affixing jewelry to an interfacer. Adhesively adhering can include any technique using any adhesive such as, but not limited to, cyanoacrylate, jewelry adhesive, urea-formaldehyde, resorcinol, phenol formaldehyde resin, animal glues, polyvinyl acetate, polyurethane glue, epoxy, contact cement, hot melt, hot bitumen, cold adhesives, any combination thereof, or any other adhesive capable of affixing jewelry to an interfacer. Chemical bonding can include any technique such as, but not limited to, melting, smelting, or any technique capable of affixing jewelry to an interfacer. For ease, at times, a beaded necklace is described as having an end bead retained by a jewelry retaining region. This is in no way meant to be a limitation, rather it is merely for ease.

Figure 5B:
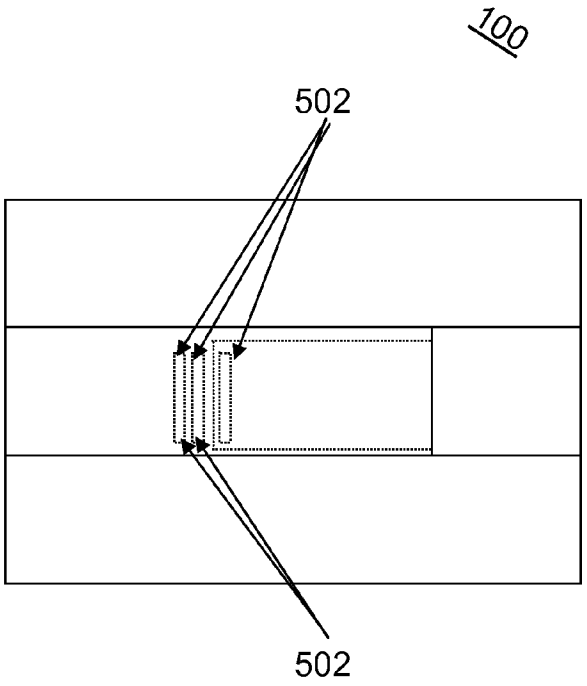
FIGS. 5A-5B illustratively depict at least one magnetic material located in a jewelry clasp of the present invention.
Figure 5A:
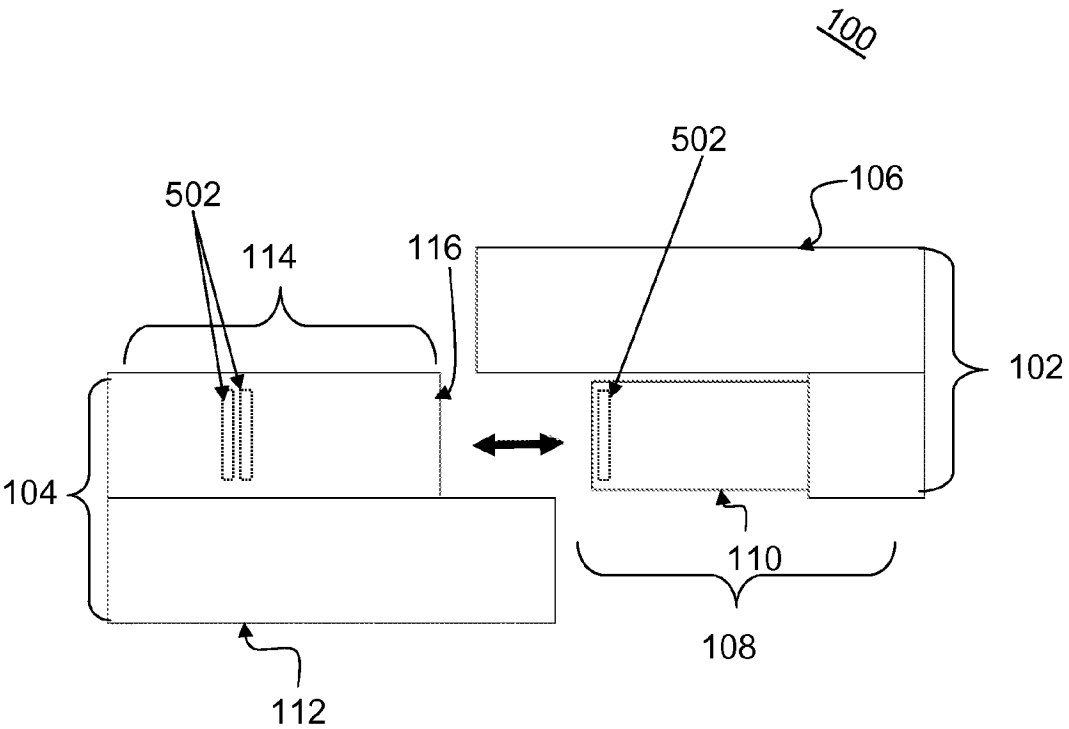

Referring to FIGS. 5A-5B, in exemplary embodiments, at least one magnetic material 502 can be located at can be substantially near the distal tip of cantilevered male protrusion 110 and/or substantially near the base of female magnetic interfacing region 114. Further, a plurality of magnetic materials 502 can be located at the distal tip of cantilevered male protrusion 110 and/or substantially near the base of female magnetic interfacing region 114.

In exemplary embodiments, although not shown, at least one magnetic material 502 can be located at any reasonable location in first and second jewelry interfacer 102/104. For example, at least one magnetic material 502 can be substantially near the distal tip of cantilevered male protrusion 110, along at least some length of cantilevered male protrusion 110, substantially near the base of female magnetic interfacing region 114, along at least some length of second jewelry retaining region 112, along at least some length of female magnetic interfacing region 114, and/or along at least some length of male magnetic interfacing region 108, to name a few. Further, a plurality of magnetic material 502 can be located at any reasonable location in first and second jewelry interfacer 102/104. For example, a plurality of magnetic materials 502 can be located at the distal tip of cantilevered male protrusion 110 and/or substantially near the base of female magnetic interfacing region 114. As another example, a plurality of magnetic materials 502 can be located at least partially along the length of cantilevered male protrusion 110 and/or along at least some length of second jewelry retaining region 112 and/or along at least some length of female magnetic interfacing region 114.

In exemplary embodiments, although not shown, cantilevered male protrusion 110 can be and/or can be constructed substantially of at least one magnet. For example, cantilevered male protrusion 110 can be a single magnet and/or can be and/or can be constructed from a plurality of magnets.

It will be understood that at least one magnetic material 502 can be any form of magnet, ferrous material, any combination thereof, or any other material capable of generating and/or interacting with magnetic forces. For example, at least one magnet can be located at the distal tip of cantilevered male protrusion 110 and a ferrous material can be located substantially near the base of female magnetic interfacing region 114. As another example, at least one magnet can be located at the distal tip of cantilevered male protrusion 110 and at least one magnet can be located substantially near the base of female magnetic interfacing region 114. For ease, at times, at least one magnetic material 502 is described as a magnet. This is in no way meant to be a limitation, rather it is merely for ease.

Figure 6A:
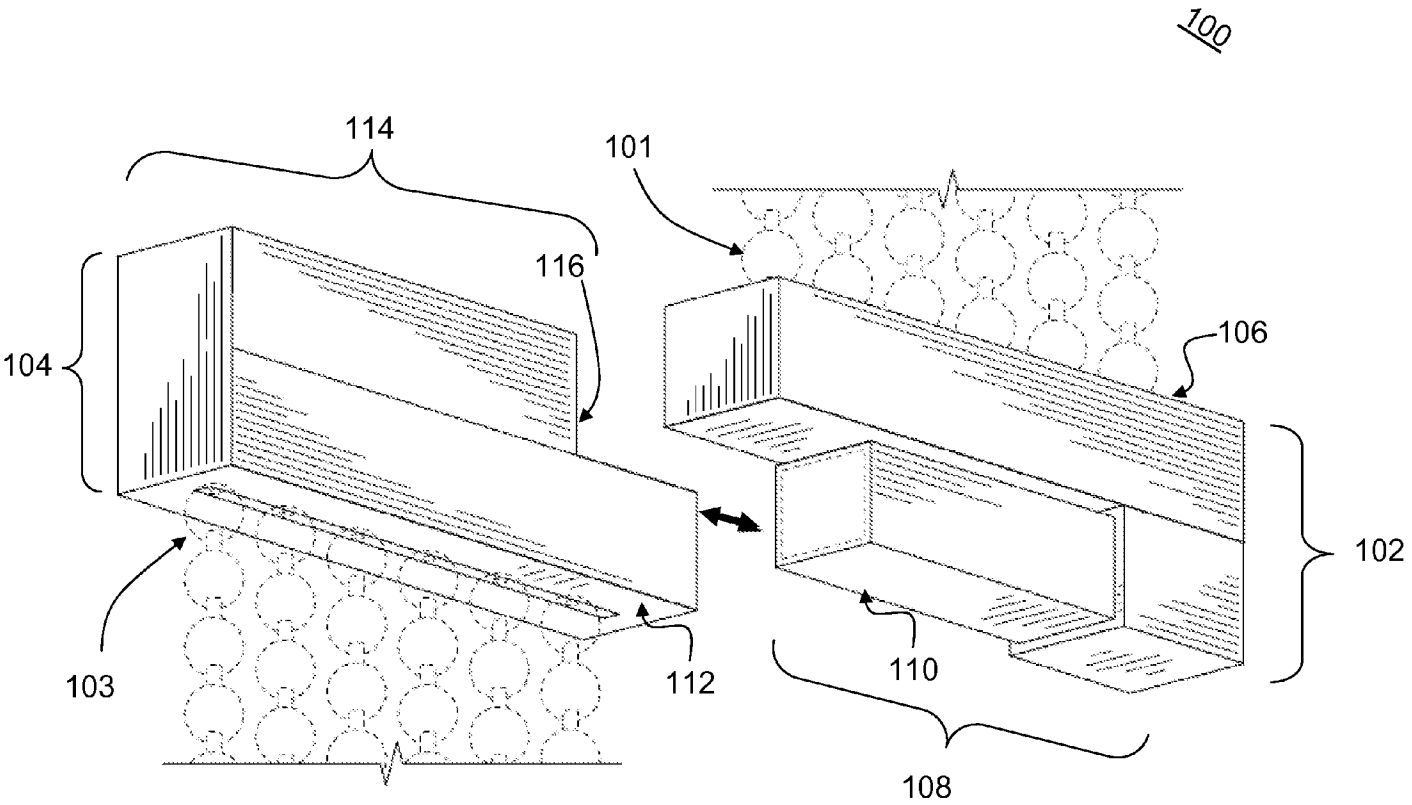
FIGS. 6A-6B illustratively depict various cross-sectional shapes of elements of a jewelry clasp of the present invention.
Figure 6B:
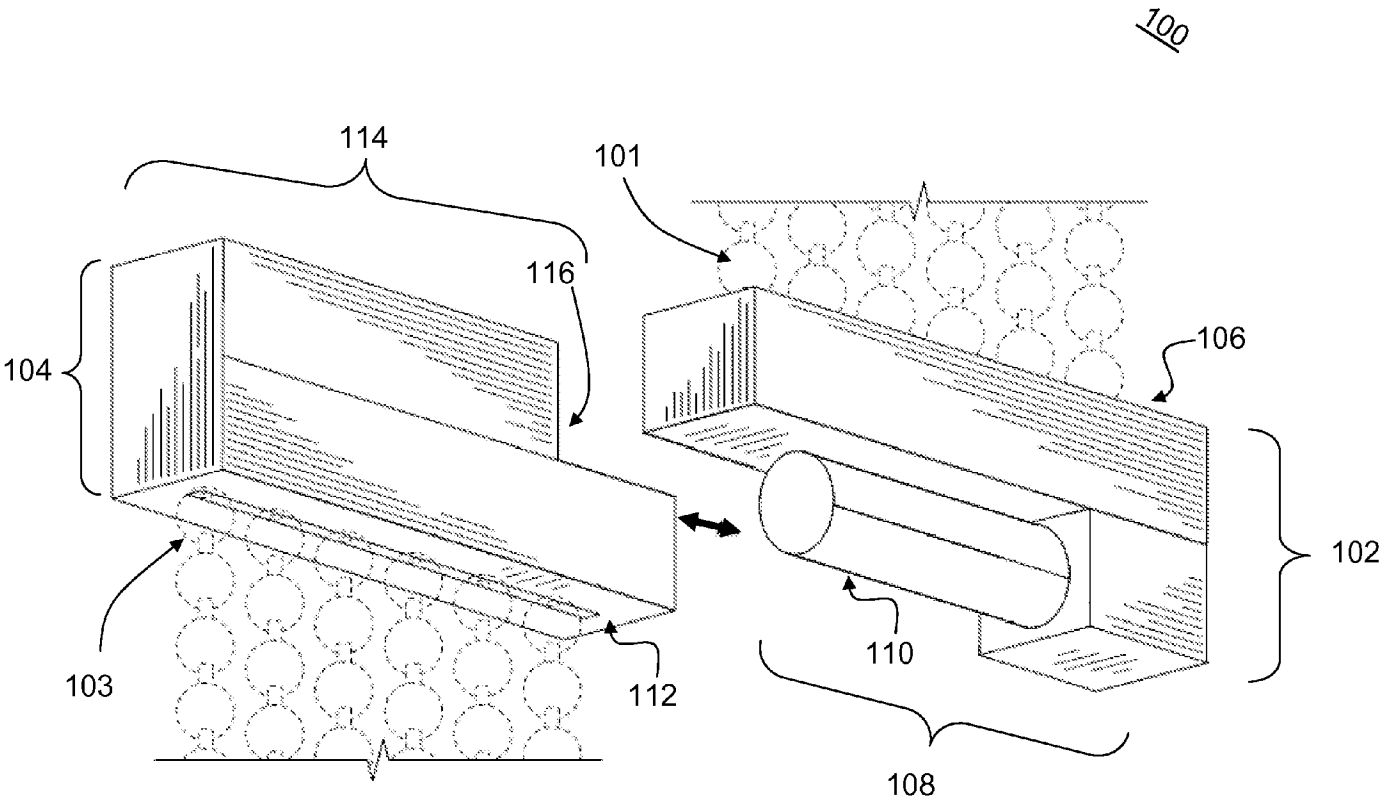
Figure 7A:
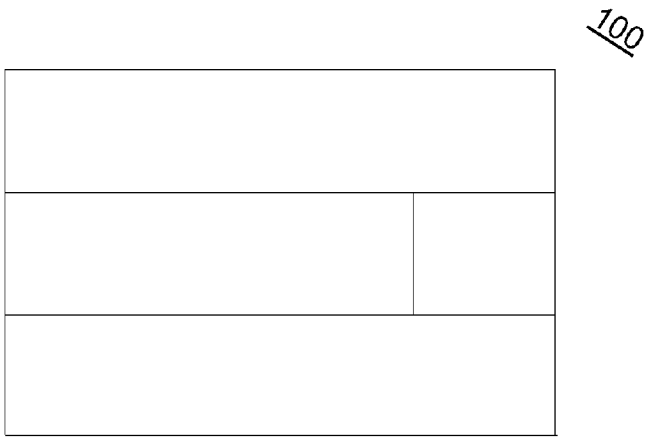
FIGS. 7A-8B illustratively depict various shaped elements of a jewelry clasp and various shaped jewelry clasps of the present invention.
Figure 7B:
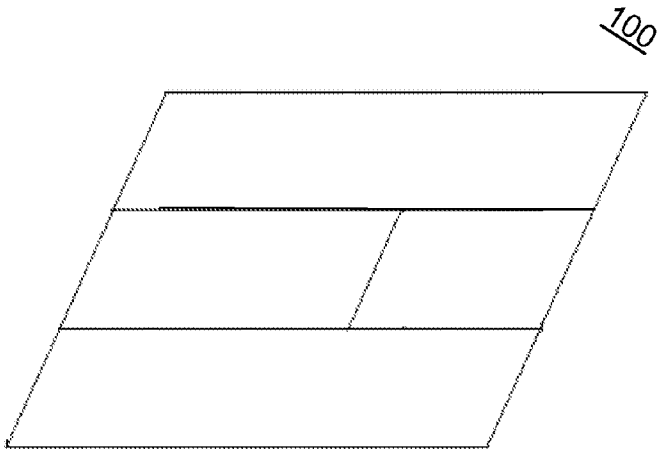
Figure 7C:
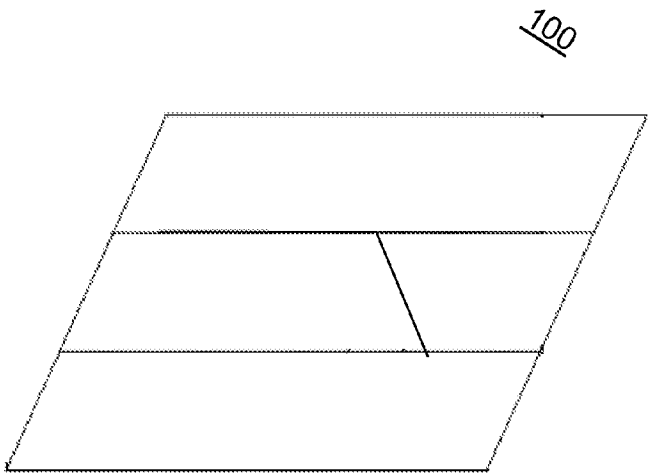
Figure 8B:
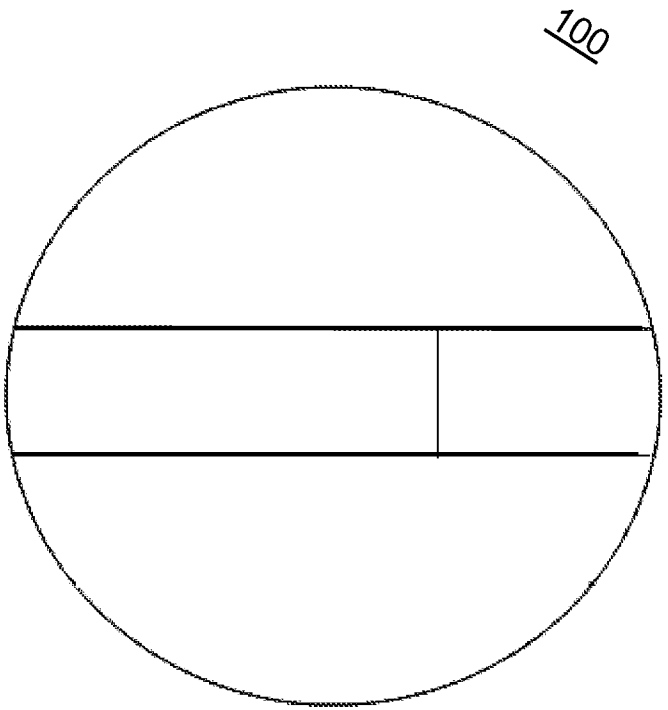
Figure 8A:
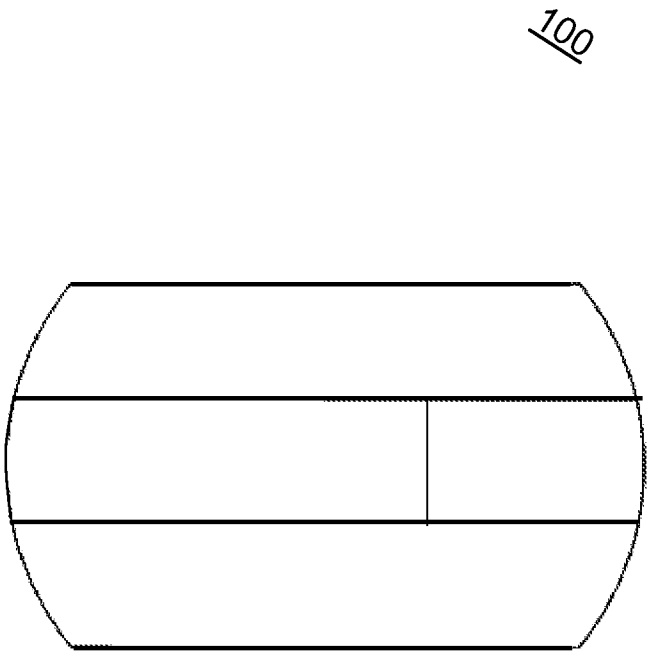
Figure 10A:
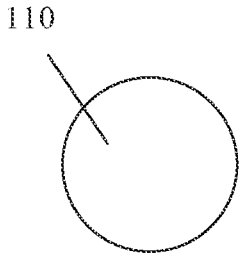
FIGS. 10A-10V show various cross-sectional shapes of first jewelry retaining region, male magnetic interfacing region, cantilevered male protrusion, second jewelry retaining region, female magnetic interfacing region, and/or female receiving region of a jewelry clasp according to exemplary embodiments of the present invention.
Figure 10B:
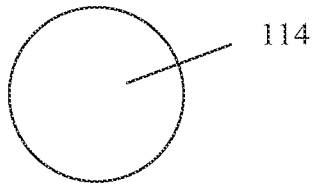
Figure 10C:
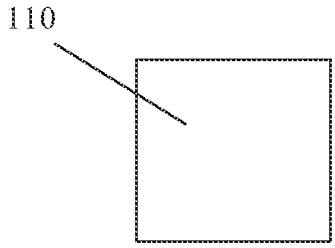
Figure 10D:
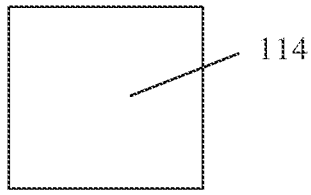
Figure 10E:
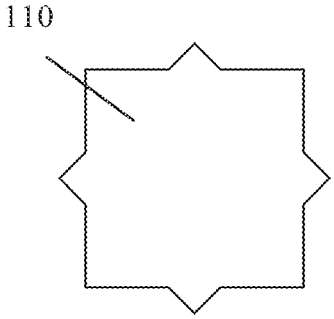
Figure 10F:
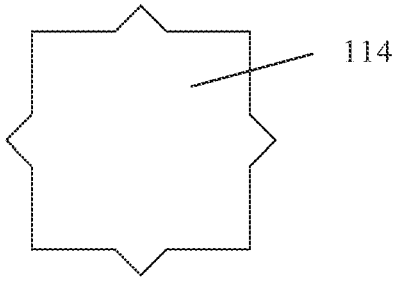
Figure 10G:
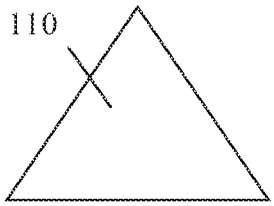
Figure 10H:
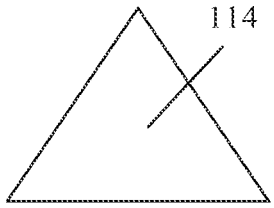
Figure 10I:
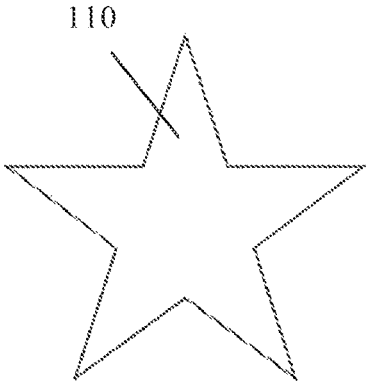
Figure 10J:
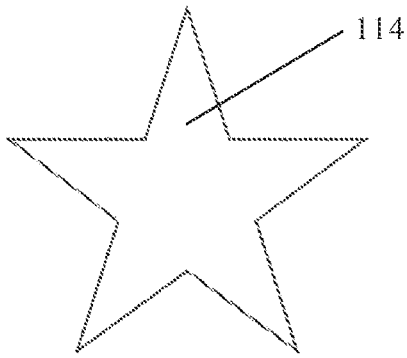
Figure 10K:
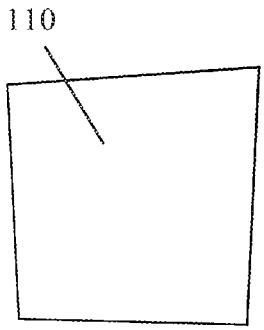
Figure 10L:
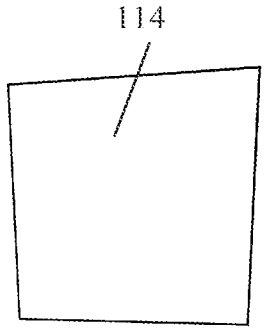
Figure 10M:
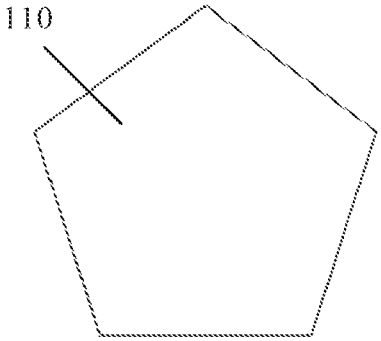
Figure 10N:
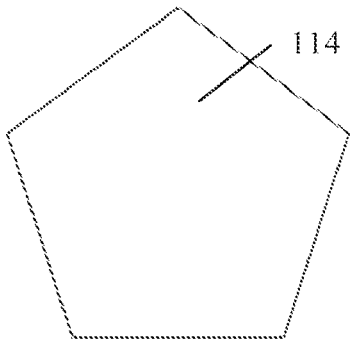
Figure 10O:
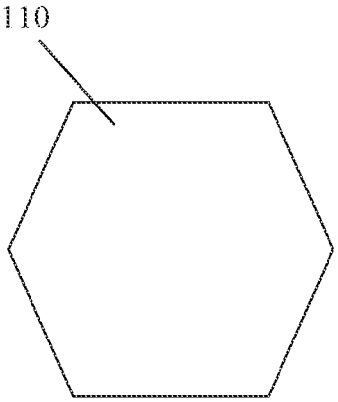
Figure 10P:
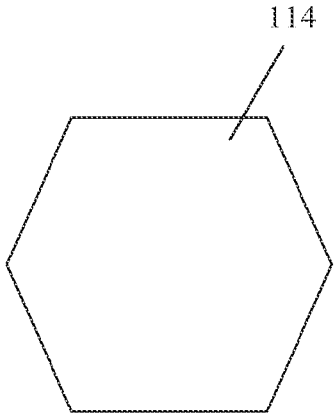
Figure 10Q:
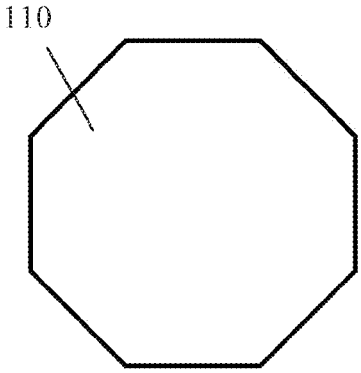
Figure 10R:
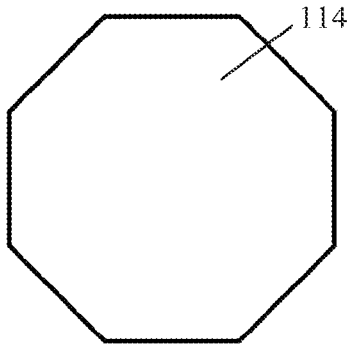
Figure 10S:
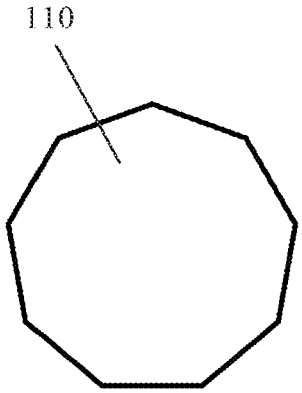
Figure 10T:
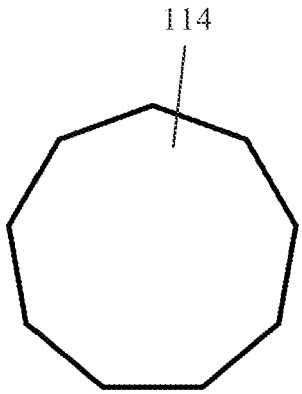
Figure 10U:
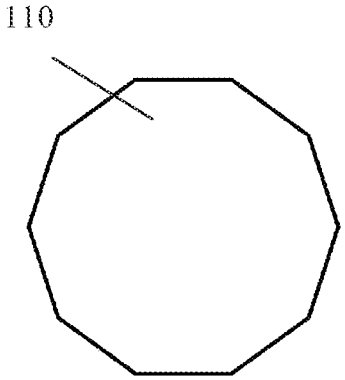
Figure 10V:
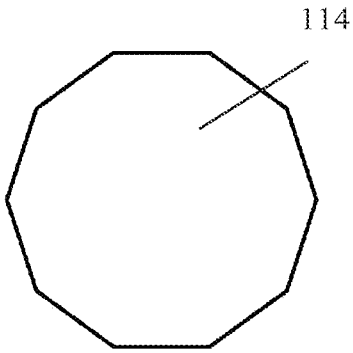

Referring to FIGS. 6A-6B, in exemplary embodiments, first jewelry retaining region 106, male magnetic interfacing region 108, cantilevered male protrusion 110, second jewelry retaining region 112, female magnetic interfacing region 114, and/or female receiving region 116 can have any reasonable cross-sectional shape, such as, but not limit to, round (FIGS. 10A and 10B), square (FIGS. 10C and 10D), polygonal (FIGS. 10E and 10F), triangular (FIGS. 10G and 10H), star shaped (FIGS. 10I and 10J), quadrilateral (FIGS. 10K and 10L), pentagonal (FIGS. 10M and 10N), hexagonal (FIGS. 10O and 10P), octagonal (FIGS. 10Q and 10R), enneagonal (FIGS. 10S and 10T), and decagonal (FIGS. 10U and 10V), to name a few.

For example, referring to FIG. 6A, each of first jewelry retaining region 106, male magnetic interfacing region 108, cantilevered male protrusion 110, second jewelry retaining region 112, female magnetic interfacing region 114, and/or female receiving region 116 can have a cross-sectional shape which is substantial square. As another example, referring to FIG. 6B, cantilevered male protrusion 110 and female receiving region 116 can have a cross-sectional shape which is substantial rounded while first jewelry retaining region 106, male magnetic interfacing region 108, second jewelry retaining region 112, and female magnetic interfacing region 114 can have a cross-sectional shape which is substantially square.

As yet another example, although not shown, cantilevered male protrusion 110 and female receiving region 116 can have a cross-sectional shape which is substantially round and female magnetic interfacing region 114, male magnetic interfacing region 108, first jewelry retaining region 106, and second jewelry retaining region 112 can include at least one curved surface. This may be done such that first and second jewelry interfacer 102/104 can be capable of pivoting relative to each other. Any of the elements of jewelry clasp 100 can include a cross-sectional shape capable of producing at least one curved surface. For ease, at times, the cross-sectional shape of first jewelry retaining region 106, male magnetic interfacing region 108, cantilevered male protrusion 110, second jewelry retaining region 112, female magnetic interfacing region 114, and/or female receiving region 116 is described as being substantially square. This is in no way meant to be a limitation, rather it is merely for ease.

Referring to FIGS. 7A-8B, in exemplary embodiments, first jewelry retaining region 106, male magnetic interfacing region 108, cantilevered male protrusion 110, second jewelry retaining region 112, female magnetic interfacing region 114, female receiving region 116, or any other elements of jewelry clasp 100 can be shaped and these shapes can be combined when jewelry clasp 100 is coupled forming a geometric shape. For example, referring to FIGS. 7A-7C, each of the elements of jewelry clasp 100 and/or the overall shape of jewelry clasp 100 when coupled can have a substantially hexahedron shape such as, but not limited to, cuboid, parallelepiped, rhombohedron, trigonal trapezohedron, any combination thereof, or any other reasonable hexahedron shape. As another example, referring to FIGS. 8A-8B, each of the elements of jewelry clasp 100 and/or the overall shape of jewelry clasp 100 when coupled can have a substantially disc shape, a substantially spheroid shape, a substantial ellipsoidal shape, any combination thereof, or any other reasonable shape.

Figure 9B:
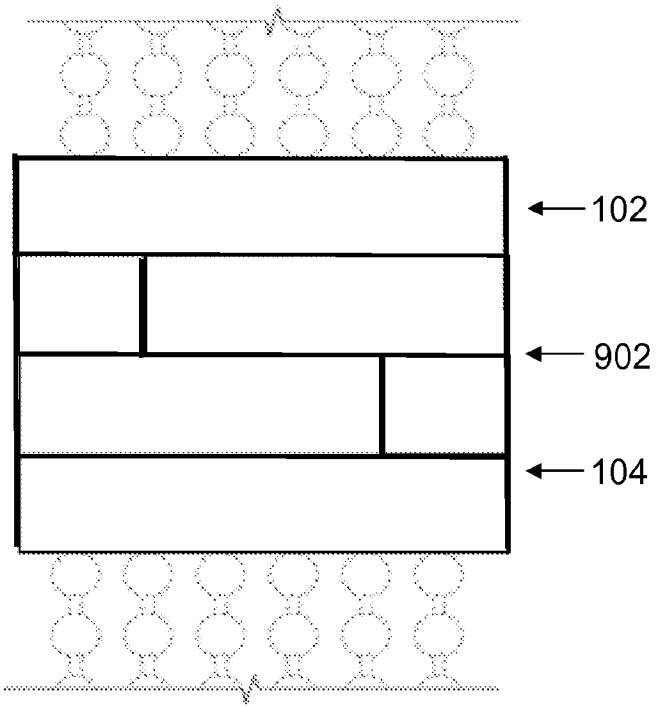
FIGS. 9A-9B illustratively depict an interim element of a jewelry clasp of the present invention.
Figure 9A:
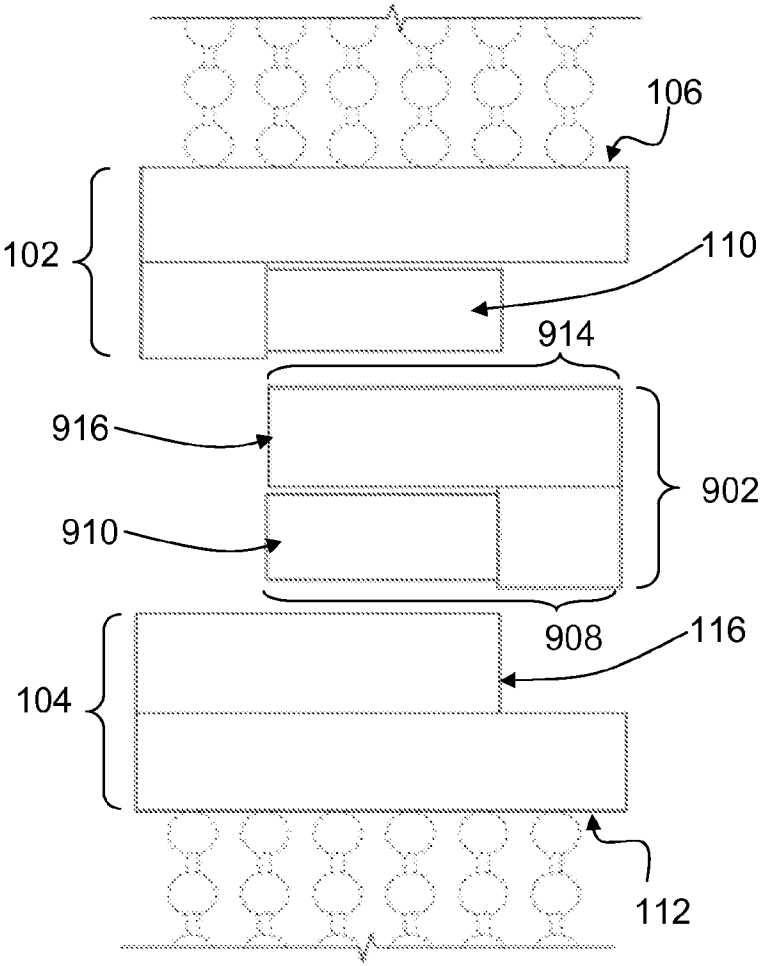

Referring to FIGS. 9A-9B, in exemplary embodiments, jewelry clasp 100 can include an at least one additional interim connector 902. For example, jewelry clasp 100 can include first jewelry interfacer 102, second jewelry interfacer 104, and an interim connector 902. Similar to first jewelry interfacer 102 and second jewelry interfacer 104, interim connector 902 can include a male magnetic interfacing region 908, a cantilevered male protrusion 910, a female magnetic interfacing region 914, and/or female receiving region 916. In use, first jewelry interfacer 102 and second jewelry interfacer 104 can couple to interim connector 902 in a substantially similar fashion to that described above for coupling first jewelry interfacer 102 and second jewelry interfacer 104. For example, cantilevered male protrusion 110 of first jewelry interfacer 102 can be received by female receiving region 916 and cantilevered male protrusion 910 can be received by female receiving region 116 of second jewelry interfacer 104.

It will be understood that any number of interim connectors 902 can be coupled together. For ease, only one interim connector 902 is described. This is in no way meant to be a limitation, rather this is merely for ease. Further, it will be understood that any of the variations first and/or second jewelry interfacer 102/104 can similarly be applied to any number of interim connectors 902.

In exemplary embodiments, any of the elements of first and/or second jewelry interfacer 102/104 can be substantially hollow, substantially solid, or any combination thereof. Further, any of the elements of first and/or second jewelry interfacer 102/104 can be constructed from any material such as, but not limited to, gold, platinum, palladium, titanium, silver, tungsten carbide, stainless steel, rhodium, any combination thereof, or any other reasonable material for constructing jewelry.

Further, first and/or second jewelry interfacer 102/104 can be about 0.5 to 10.0 centimeters in length, can have a cross-sectional shape about 1 to 20 millimeters across, and each of the components can be constructed of a material that is 0.1 to 3 millimeter thick. Further, cantilevered male protrusion 110 and female receiving region 116 can have a length of about 2 millimeters to 8 centimeters and cantilevered male protrusion 110 and female receiving region 116 can have a cross-section shape about 1 to 16 millimeters across. If jewelry clasp is square shaped, when coupled it can have a length and width of about 0.5 to 6 centimeters. If jewelry retaining regions 106/112 include a slot, the slot can be about 0.5 to 15 millimeters wide and about 1 millimeter to 10 centimeters long.

In exemplary embodiments, each of first jewelry interfacer 102, second jewelry interfacer 104, first jewelry retaining region 106, male magnetic interfacing region 108, cantilevered male protrusion 110, second jewelry retaining region 112, female magnetic interfacing region 114, female receiving region 116, and/or any other element of jewelry clasp 100 can be further combined and/or separated without deviating from the scope of the claimed invention.

Now that exemplary embodiments of the present invention have been shown and described in detail, various modifications and improvements thereon will become readily apparent to those skilled in the art.

What is claimed is:

1. A jewelry clasp, comprising:

a first jewelry interfacer having a longitudinal axis that extends parallel to a longest edge of the first jewelry interfacer, the first jewelry interfacer including a first jewelry retainer affixed to a male magnetic interfacer, the male magnetic interfacer including a cantilevered male protrusion that extends parallel to the first jewelry retainer, the first jewelry retainer retaining jewelry that extends substantially perpendicular to the longitudinal axis of the first jewelry interfacer;

a second jewelry interfacer having a longitudinal axis that extends parallel to a longest edge of the second jewelry interfacer, the second jewelry interfacer including a second jewelry retainer affixed to a female magnetic interfacer, the female magnetic interfacer including a female receiving region that extends parallel to the second jewelry retainer, the second jewelry retainer retaining jewelry that extends substantially perpendicular to the longitudinal axis of the second jewelry interfacer;

wherein the cantilevered male protrusion of the first jewelry interfacer is capable of being received into the female receiving region of the second jewelry interfacer and the first jewelry interfacer and the second jewelry interfacer magnetically couple to each other such that the cantilevered male protrusion and the female receiving region are substantially parallel to each other and the first and second jewelry retainers retain jewelry that extends substantially perpendicular to the cantilevered male protrusion and the female receiving region, wherein a region of the female magnetic interfacer includes at least one magnet and a region of the cantilevered male protrusion includes at least one magnet.

2. The jewelry clasp of claim 1, wherein when force is applied by jewelry retained in at least one of the first and second jewelry retainers at least some of a retaining force is distributed on the cantilevered male protrusion by a moment and shear stress.

3. The jewelry clasp of claim 1, wherein the first jewelry interfacer and the second jewelry interfacer are decoupled with substantial ease by applying a force slightly greater than a magnetic coupling force in a direction that is substantially parallel to the cantilevered male protrusion.

4. The jewelry clasp of claim 1, wherein at least one of a region of the female magnetic interfacer and a region of the cantilevered male protrusion include at least one of a magnet and ferromagnetic material.

5. The jewelry clasp of claim 1, wherein the at least one magnet of the cantilevered male protrusion is located substantially near a distal most point of the cantilevered male protrusion.

6. The jewelry clasp of claim 1, where the at least one magnet of the female magnetic interfacer is located at substantially near a deepest point of the female region.

7. The jewelry clasp of claim 1, wherein a cross-sectional shape of the cantilevered male protrusion and the female magnetic interfacer is at least one of substantially round, square, polygonal, triangular, star shaped, quadrilateral, pentagonal, hexagonal, octagonal, enneagonal, and decagonal.

8. The jewelry clasp of claim 1, wherein a cross-sectional shape of the cantilevered male protrusion and the female magnetic interfacer are square.

9. The jewelry clasp of claim 1, wherein the first jewelry retainer, the second jewelry retainer, the male magnetic interfacer, the cantilevered male protrusion, and the female magnetic interfacer are each at least one of a rectangular cuboid, a square cuboid, and a parallelepiped shape.

10. The jewelry clasp of claim 1, wherein the cantilevered male protrusion and the female magnetic interfacer are each at least one of a rectangular cuboid, a square cuboid, and a parallelepiped shape.

11. The jewelry clasp of claim 1, wherein when the first jewelry interfacer and the second jewelry interfacer are coupled they form at least one of a rectangular cuboid, a square cuboid, and a parallelepiped shape.

12. The jewelry clasp of claim 1, wherein the first jewelry retainer and the second jewelry retainer are designed to retain at least one string of beads.

13. The jewelry clasp of claim 12, wherein the at least one string of beads are retained in a channel.

14. The jewelry clasp of claim 1, wherein the male magnetic interfacer and the cantilevered male protrusion are substantially one cantilevered male magnetic interfacer that is affixed to the first jewelry retainer.

15. The jewelry clasp of claim 1, wherein at least one of the first jewelry retainer, the second jewelry retainer, the male magnetic interfacer, the cantilevered male protrusion, and the female magnetic interfacer are at least partially constructed of at least one of gold, silver, platinum, aluminum, pewter, and palladium.

16. The jewelry clasp of claim 1, further comprising at least one interim jewelry interfacer including an interim female magnetic interfacer affixed to an interim male magnetic interfacer such that the interim female magnetic interfacer and the interim male magnetic interfacer are affixed in a position substantially parallel to each other, the interim male magnetic interfacer including an interim cantilevered male protrusion; the interim female magnetic interfacer being capable receiving the cantilevered male protrusion of the first jewelry interfacer such that the interim female magnetic interfacer and the first jewelry interfacer are magnetically coupled; the interim cantilevered male protrusion being capable of being inserted into the female magnetic interfacer of the second jewelry interfacer such that the interim cantilevered male protrusion and the second jewelry interfacer are magnetically coupled.

17. The jewelry clasp of claim 1, wherein the jewelry retained by the first and second jewelry retainers extends at a non-zero angle substantially perpendicular to the cantilevered male protrusion and the female receiving region.

18. The jewelry clasp of claim 1, wherein the first jewelry retainer and the male magnetic interfacer are affixed in a position substantially parallel to each other and the second jewelry retainer and the female magnetic interfacer are affixed in a position substantially parallel to each other.

19. The jewelry clasp of claim 1, wherein the cantilevered male protrusion extends substantially parallel to the first jewelry retainer and the female receiving region is substantially parallel to the second jewelry retainer.

* * * * *